US010010110B2

(12) United States Patent
Metrangolo et al.

(10) Patent No.: US 10,010,110 B2
(45) Date of Patent: Jul. 3, 2018

(54) ELECTRICALLY OPERATED AEROSOL GENERATING SYSTEM

(71) Applicant: Philip Morris Products S.A., Neuchatel (CH)

(72) Inventors: Alessandro Metrangolo, Neuchatel (CH); Pierre-Yves Gindrat, Saxon (CH); John Faulkner, Gorgier (CH); Jean-Pierre Schaller, Geneva (CH); Jean-Claude Schneider, Auvernier (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 14/404,549

(22) PCT Filed: May 30, 2013

(86) PCT No.: PCT/EP2013/061211
§ 371 (c)(1),
(2) Date: Nov. 28, 2014

(87) PCT Pub. No.: WO2013/178769
PCT Pub. Date: Dec. 5, 2013

(65) Prior Publication Data

US 2015/0107611 A1 Apr. 23, 2015

(30) Foreign Application Priority Data

May 31, 2012 (EP) ..... 12170360

(51) Int. Cl.
*A24F 13/00* (2006.01)
*A24F 47/00* (2006.01)
(Continued)

(52) U.S. Cl.
CPC ..... *A24F 47/008* (2013.01); *A24B 13/00* (2013.01); *A24C 5/18* (2013.01); *A24D 1/02* (2013.01); *A24F 47/004* (2013.01)

(58) Field of Classification Search
None
See application file for complete search history.

(56) References Cited

U.S. PATENT DOCUMENTS 3,246,655 A 4/1966 Spears
3,472,236 A 10/1969 Dearsley
(Continued)

FOREIGN PATENT DOCUMENTS

CH 691 156 A5 5/2001
CN 1333657 A 1/2002
(Continued)

OTHER PUBLICATIONS

International Search Report and Written Opinion dated Oct. 7, 2013 in PCT/EP2013/061211 filed May 30, 2013.
(Continued)

*Primary Examiner* — Michael H Wilson
*Assistant Examiner* — Phu H. Nguyen
(74) *Attorney, Agent, or Firm* — Oblon, McClelland, Maier & Neustadt, L.L.P.

(57) ABSTRACT

A rod is provided, formed from a first sheet including an aerosol-forming material and a second sheet including a non-tobacco material, the first and second sheets being gathered together and circumscribed by a wrapper. The rod may be used as a component part of an aerosol-generating article. The second sheet preferably includes a material configured to modify an aerosol evolved from the aerosol-forming material or to modify other properties of the rod.

10 Claims, 3 Drawing Sheets

(51) Int. Cl.

| | |
|---|---|
| ***A24D 1/02*** | (2006.01) |
| ***A24B 13/00*** | (2006.01) |
| ***A24C 5/18*** | (2006.01) |

(56) References Cited

U.S. PATENT DOCUMENTS

| | | | | |
|---|---|---|---|---|
| 3,860,012 | A | 1/1975 | Selke | |
| 3,894,544 | A | 7/1975 | Egri | |
| 4,000,748 | A | 1/1977 | Summers | |
| 4,047,536 | A | 9/1977 | Asfour | |
| 4,168,712 | A | 9/1979 | Labbe | |
| 4,291,711 | A | 9/1981 | Berger | |
| 4,355,995 | A | 10/1982 | Berger | |
| 4,391,285 | A | 7/1983 | Burnett et al. | |
| 4,807,808 | A | 2/1989 | Reed | |
| 4,928,714 | A | 5/1990 | Shannon | |
| 5,101,839 | A | 4/1992 | Jakob et al. | |
| 5,271,419 | A | 12/1993 | Arzonico et al. | |
| 5,360,023 | A | 11/1994 | Blakley et al. | |
| 5,433,224 | A | 7/1995 | Luke et al. | |
| 5,724,998 | A | 3/1998 | Gellatly et al. | |
| 6,761,175 | B2 | 7/2004 | Nakanishi et al. | |
| 7,998,274 | B2 | 8/2011 | Rodrigues et al. | |
| 2003/0154991 | A1 | 8/2003 | Fournier et al. | |
| 2005/0039767 | A1 | 2/2005 | Mua et al. | |
| 2005/0072438 | A1 | 4/2005 | Darwish | |
| 2007/0023056 | A1 | 2/2007 | Cantrell et al. | |
| 2008/0092912 | A1* | 4/2008 | Robinson | A24F 47/008 131/200 |
| 2008/0163879 | A1 | 7/2008 | Rodrigues et al. | |
| 2009/0038629 | A1* | 2/2009 | Ergle | A24B 15/282 131/276 |
| 2009/0065011 | A1 | 3/2009 | Maeder et al. | |
| 2010/0200006 | A1 | 8/2010 | Robinson et al. | |
| 2011/0036364 | A1 | 2/2011 | Pienemann et al. | |
| 2012/0017925 | A1 | 1/2012 | Sebastian et al. | |
| 2012/0031414 | A1 | 2/2012 | Atchley et al. | |
| 2012/0060853 | A1 | 3/2012 | Robinson et al. | |
| 2012/0067360 | A1 | 3/2012 | Conner et al. | |

FOREIGN PATENT DOCUMENTS

| | | | |
|---|---|---|---|
| CN | 1633247 | A | 6/2005 |
| CN | 101778578 | A | 7/2010 |
| CN | 101970323 | A | 2/2011 |
| DE | 198 54 009 | A1 | 5/2000 |
| EP | 0 342 538 | A2 | 11/1989 |
| EP | 0 503 767 | A1 | 9/1992 |
| EP | 0 532 329 | A2 | 3/1993 |
| EP | 0 822 670 | A2 | 2/1998 |
| EP | 1 889 550 | A1 | 2/2008 |
| EP | 2 062 484 | A1 | 5/2009 |
| EP | 2 100 840 | A1 | 9/2009 |
| GB | 983 928 | | 2/1965 |
| GB | 1 197 174 | | 7/1970 |
| JP | 51-012999 | | 1/1976 |
| JP | 52-10500 | | 1/1977 |
| JP | 1-243979 | | 9/1989 |
| JP | H01-243979 | A | 9/1989 |
| JP | 2-53476 | | 2/1990 |
| JP | 05-103836 | | 4/1993 |
| JP | 9-107942 | | 4/1997 |
| JP | H09-107942 | A | 4/1997 |
| JP | 9-316420 | | 12/1997 |
| JP | 11-103839 | | 4/1999 |
| JP | 2009-502194 | | 1/2009 |
| JP | 2010-506594 | | 3/2010 |
| JP | 2010-535530 | | 11/2010 |
| JP | 2011-512853 | | 4/2011 |
| JP | 2015-517517 | A | 6/2015 |
| JP | 2015-523857 | A | 8/2015 |
| RU | 2 214 141 | C2 | 10/2003 |
| RU | 2 344 629 | C2 | 2/2009 |
| RU | 2 356 458 | C2 | 5/2009 |
| RU | 2 410 993 | C2 | 2/2011 |
| TW | 201043157 | A1 | 12/2010 |
| UA | 88318 | C2 | 10/2009 |
| WO | WO 2009/021018 | A1 | 2/2009 |
| WO | WO 2009/022232 | A1 | 2/2009 |
| WO | WO 2010/047389 | A1 | 4/2010 |
| WO | WO 2010/113702 | A1 | 10/2010 |
| WO | WO 2011/101164 | A1 | 8/2011 |
| WO | WO 2012/012053 | A1 | 1/2012 |
| WO | WO 2013/120566 | A2 | 8/2013 |

OTHER PUBLICATIONS

Extended Search Report dated Mar. 19, 2013 in 12170356.5.

International Preliminary Report on Patentability dated Dec. 11 2014 in PCT/EP2013/061208 filed May 30, 2013.

Written Opinion dated Oct. 2, 2013 in PCT/EP2013/061208 filed May 30, 2013.

Partial Search Report dated Nov. 30, 2012 in European Patent Application No. 12170356.5.

International Search Report dated Oct. 2, in PCT/2013061208 Filed May 30, 2013.

International Search Report and Written Opinion dated Sep. 30, 2013 in PCT/EP2013/061210 filed May 30, 2013.

Written Opinion of the International Searching Authority dated Sep. 30, 2013 in PCT/EP13/061209 Filed May 30, 2013.

International Search Report dated Sep. 30, 2013 in PCT/EP2013/061209 Filed May 30, 2013.

Extended Search Report dated Oct. 30 2012, in European Patent Application No. 12170359.9.

International Preliminary Report on Patentability dated Dec. 2, 2014 in PCT/EP2013/061210 filed on May 30, 2013.

Extended Search Report dated Nov. 27, 2012 in European Patent Application No. 12170360.7.

International Preliminary Report on Patentability dated Dec. 2, 2014 in PCT/EP2013/061211 filed May 30, 2013.

Extended Search Report dated Oct. 29, 2012 in European patent Application No. 12170358.1.

International Preliminary Report on Patentability dated Dec. 2, 2014 in PCT/EP2013/061209 filed May 30, 2013.

English translation of Chinese Office Action dated Jun. 27, 2016 in corresponding Chinese Patent Application No. 201380034602.2, citing documents AA, AB, AO, and AP therein. (11 pages).

English translation only of Chinese Office Action dated Feb. 20, 2017and received in the corresponding Chinese Application No. 201380034602.2, citing document AA therein (8 pages).

Japanese Office Action dated Mar. 24, 2017 in corresponding Japanese Patent Application No. 2015-514514, citing documents AA, and AO-AU therein (4 pages).

Japanese Office Action dated Mar. 24, 2017 in corresponding Japanese Patent Application No. 2015-514513, citing documents AA, AB, AO-AR, AV, and BA-BQ therein (4 pages).

Japanese Office Action dated Mar. 24, 2017 in corresponding Japanese Patent Application No. 2015-514511, citing documents BO, BR, and BS therein (4 pages).

English translation only of Decision to Grant dated Apr. 24, 2017 and received in corresponding Russian Application No. 2014153579/12(085605), citing documents AA, AB, AO, and AP therein (4 pages).

Russian Office Action dated Jun. 8, 2017 in Patent Application No. 2014153639 (with English Translation), citing documents AA-AC and AO therein (11 pages).

Russian Office Action dated Jun. 23, 2017 in Patent Application No. 2014153008 (with English Translation).

Resubmission of Japanese Office Action dated Mar. 24, 2017 in corresponding Japanese Patent Application No. 2015-514514, previously submitted on Apr. 3, 2017, now being submitted along with English translation thereof (7 pages).

Resubmission of Japanese Office Action dated Mar. 24, 2017 in corresponding Japanese Patent Application No. 2015-514513, previously submitted on Apr. 3, 2017, now being submitted along with English translation thereof (7 pages).

Resubmission of Japanese Office Action dated Mar. 24, 2017 in corresponding Japanese Patent Application No. 2015-514511, pre-

(56) References Cited

OTHER PUBLICATIONS viously submitted on Apr. 3, 2017, now being submitted along with English translation thereof (8 pages).
Combined Office Action and Search Report dated Jan. 4, 2017 in Chinese Patent Application No. 201380031712.3 (English translation only), citing document AO therein.
English language translation only of Japanese Office Action dated Apr. 17, 2017 in corresponding Japanese Patent Application No. 2015-514512, citing documents AO and AP therein, 5 pages.
Office Action dated Dec. 6, 2017 in Japanese Patent Application No. 2015-514511 (with English language translation) citing reference AO therein, 8 pages.
Office Action dated Aug. 23, 2016 in Kazak Patent Application No. 2014/2552.1 (submitting English translation only).
Combined Office Action and Search Report dated Jun. 3, 2016 in Chinese Patent Application No. 201380034575.9 (submitting English translation only).
Combined Office Action and Search Report dated Jul. 5, 2016 in Chinese Patent Application No. 201380031712.3 (submitting English translation only).
Combined Chinese Office Action and Search Report dated Jun. 20, 2016 in Patent Application No. 201380034799.X (submitting English translation only).
Japanese Office Action with English translation dated Feb. 28, 2018 in corresponding Japanese Patent Application No. 2015-514512, citing documents AO and AP therein (6 pages).
Japanese Pre-Appeal Review report with English translation dated Feb. 27, 2018 in corresponding Japanese Patent Application No. 2015-514514 (4 pages).

* cited by examiner

ELECTRICALLY OPERATED AEROSOL GENERATING SYSTEM

CROSS REFERENCE TO RELATED APPLICATION

This application is a national phase application based on PCT/EP2013/061211, filed on May, 30, 2013.

The present specification relates to rods comprising a sheet comprising an aerosol-forming material and a sheet of a non-tobacco material, the sheets being gathered together to form a rod for use in aerosol-generating articles. The specification also relates to aerosol-generating articles comprising such rods, and methods for forming such rods.

Processes and apparatus for producing shreds, strands or strips of tobacco material are known in the art. Typically, the width of such shreds, strands and strips of tobacco material is about 3 mm or less.

For example, U.S. Pat. No. 4,000,748 discloses a process and apparatus for shredding a sheet of reconstituted tobacco into strips and crimping the resultant strips in a substantially simultaneous operation. The sheet of tobacco material is moved between a pair of rotating and intermeshing stacks of disks which shred the sheet into a plurality of strips about 0.65 to 1.55 mm in width. The forward motion of the resultant strips is retarded by engagement with facing surfaces of neighbouring disks causing a buckling of the strips into a crimped configuration. The crimped strips are reported to provide an increase in fill value.

The formation of rods for aerosol-generating articles comprising crimped or uncrimped shreds of tobacco material suffers from a number of disadvantages including those discussed below.

Firstly, shredding tobacco material undesirably generates tobacco fines and other waste.

Secondly, rods comprising shreds of tobacco material exhibit 'loose ends'. That is, there is a loss of shreds of tobacco material from the ends of the rod. This is exacerbated by breakage of the shreds of tobacco material during rod formation. Loose ends are not only aesthetically undesirable, but can also disadvantageously lead to the need for more frequent cleaning of manufacturing equipment and aerosol-generating devices. The problem of loose ends is particularly exacerbated in aerosol-generating articles, because the rod length of aerosol-generating substrate tends to be low in comparison with conventional cigarettes, and therefore the proportion of substrate material that is in proximity to an end is greater.

Thirdly, rods comprising shreds of tobacco material exhibit high weight standard deviations. That is, rods of the same dimensions tend to be of inconsistent weight. This is due in part to the tendency of the rods to exhibit loose ends as mentioned above. The high weight standard deviation of rods comprising shreds of tobacco material leads to an undesirably high rejection rate of rods whose weight falls outside of a selected acceptance range. Furthermore, rods comprising shreds of tobacco material exhibit non-uniform densities. That is, the density along the rod length of the rod tends to be inconsistent. This is due to variations in the quantity of tobacco material at different locations along the rod, which results in 'voids', which are regions having reduced quantities of tobacco material, and 'pads', which are regions having increased levels of tobacco material. The non-uniform density of rods comprising shreds of tobacco material can undesirably affect the resistance to draw (RTD) of the rods. In addition, the non-uniform density of rods comprising shreds of tobacco material can lead to loose ends when a void is located at the end of the rod.

Loose ends, high weight standard deviations and non-uniform densities as exhibited by rods comprising shreds of tobacco material are particularly problematic and undesirable in rods of short rod length. Rods of short rod length are sometimes referred to as plugs.

EP-A1-2 062 484 discloses a process for forming smokeless tobacco articles for oral consumption. A sheet of reconstituted tobacco is gathered into a rod, wrapped, and cut into pieces suitable for oral consumption.

It would be desirable to provide rods comprising tobacco material for use in aerosol-generating articles.

A rod may be provided comprising a first sheet comprising an aerosol-forming material and a second sheet of non-tobacco material, the first and second sheet being gathered together and circumscribed by a wrapper.

The gathered sheets of material preferably extend along substantially the entire length of the rod and across substantially the entire transverse cross-sectional area of the rod.

Preferred aerosol-forming materials comprise tobacco. The first sheet may be a sheet of reconstituted tobacco or homogenised tobacco, preferably a sheet of reconstituted tobacco or homogenised tobacco comprising an aerosol-former.

The first sheet may be a sheet of non-tobacco material that comprises an aerosol-former or aerosol-forming component. For example, the first sheet may be a sheet of paper material or polymeric material that is impregnated or coated with nicotine and an aerosol-former. The first sheet may be a sheet of paper material or polymeric material that is impregnated or coated with a flavourant and an aerosol-former. The first sheet may be a sheet of paper material or polymeric material that is impregnated or coated with a scent compound and an aerosol-former.

The second sheet is a non-tobacco sheet that preferably comprises a functional component for modifying an aerosol evolved from the first sheet.

As used herein, the term 'rod' is used to denote a generally cylindrical element of substantially circular, oval or elliptical cross-section.

As used herein, the term 'sheet' denotes a laminar element having a width and length substantially greater than the thickness thereof. The width of a sheet is greater than 10 mm, preferably greater than 20 mm or 30 mm.

As used herein, the term "aerosol-forming material" denotes a material that is capable of releasing volatile compounds upon heating to generate an aerosol. An aerosol-forming substrate may comprise or consist of an aerosol-forming material.

As used herein, the term 'rod length' denotes the dimension in the direction of the cylindrical axis of rods as described herein.

As used herein, the term 'homogenised tobacco material' denotes a material formed by agglomerating particulate tobacco.

As used herein, the term 'gathered' denotes that the sheet of tobacco material is convoluted, folded, or otherwise compressed or constricted substantially transversely to the cylindrical axis of the rod.

As used herein, the terms 'upstream' and 'downstream' are used to describe the relative positions of components, or portions of components, of aerosol-generating articles comprising rods as described herein in relation to the direction of air drawn through the aerosol-generating articles during use thereof.

A rod formed from a gathered sheet of a suitable aerosol-forming material may be particularly beneficial as a component of an aerosol-generating article, particularly a heated aerosol-generating article.

Heated aerosol-generating systems operate by heating an aerosol-forming substrate to generate an aerosol from the material of the substrate. The aerosol can then be inhaled by a consumer. It may be desirable to modify the aerosol. For example, aerosols generated from tobacco materials may often contain compounds such as phenols and cresols. These types of components may introduce an unpleasant taste to the aerosol or may be otherwise undesirable.

The second sheet may be a sheet that comprises an adsorbent for adsorbing unwanted components of an aerosol evolved from the first sheet. The second sheet may be a sheet that is an adsorbent for adsorbing unwanted components of an aerosol evolved from the first sheet. In this way, a proportion of undesirable components of the aerosol may be reduced prior to the aerosol being consumed. An example of a sheet material that may reduce phenol concentration in an aerosol evolved from a tobacco material is polylactic acid (PLA). A further example of a sheet material that may reduce undesirable components of an aerosol is carbon.

The second sheet may comprise a paper or polymer sheet that is coated with or impregnated with a material that reacts with an aerosol component. For example the second sheet could be a paper or polymer that is impregnated with a liquid compound that chemically reacts with an aerosol component.

The second sheet may comprise a humectant to humidify the aerosol evolved from the first sheet.

The second sheet may comprise an aerosol-former to dilute the aerosol evolved from the first sheet to modify the strength or flavour of the aerosol.

The second sheet may comprise a flavourant for modifying the flavour of the aerosol.

The second sheet may comprise a material having a high thermal conductivity for modifying the temperature of the aerosol.

The second sheet may act as a filler or ballast to bulk up a rod comprising a sheet of aerosol-forming material. For example, an aerosol-forming material may be expensive and it may be desirable to economically produce a rod having predetermined dimensions. By using an expensive sheet comprising the aerosol-forming material, for example a sheet of tobacco, and an inexpensive material, for example paper, a rod can be produced that comprises the aerosol-forming material. Filler or ballast may also be used to dilute the intensity of an aerosol generated from the rod.

The second sheet may be added to the rod to modify air-flow through the rod. For example, variations in the dimensions and morphology of the second sheet may allow for the modification or tuning of airflow through the rod.

The second sheet may have more than one function. The second sheet may comprise a metallic foil coated with a humectant. The foil may increase thermal transfer within the rod, while the humectant may increase the moisture content of the aerosol.

The first sheet of material may be a textured sheet of material. Use of a textured sheet of material may advantageously facilitate gathering of the sheet to form a rod as described herein. The second sheet of material may be a textured sheet of material. Both the first and second sheets of material may be textured sheets of material.

As used herein, the term 'textured sheet' denotes a sheet that has been crimped, embossed, debossed, perforated or otherwise deformed. Textured sheets of material, such as homogenised tobacco, for use in forming rods as described herein may comprise a plurality of spaced-apart indentations, protrusions, perforations or a combination thereof.

According to a particularly preferred embodiment there is provided a rod comprising a crimped sheet of aerosol-forming material and a sheet of PLA, the sheets being gathered together and circumscribed by a wrapper.

As used herein, the term 'crimped sheet' is intended to be synonymous with the term 'creped sheet' and denotes a sheet having a plurality of substantially parallel ridges or corrugations. Preferably, a crimped sheet of aerosol-forming material, for example a crimped sheet of homogenised tobacco material, has a plurality of ridges or corrugations substantially parallel to the cylindrical axis of the rod according to the specification. This advantageously facilitates gathering of the crimped sheet of aerosol-forming material to form the rod. However, it will be appreciated that crimped sheets of aerosol-forming material may alternatively or in addition have a plurality of substantially parallel ridges or corrugations disposed at an acute or obtuse angle to the cylindrical axis of the rod.

In certain embodiments, sheets of material may be substantially evenly textured over substantially their entire surface. For example, crimped sheets of material may comprise a plurality of substantially parallel ridges or corrugations that are substantially evenly spaced-apart across the width of the sheet.

A rod as described herein may comprise one or more additional sheets of material gathered together with the first and second sheets to form the rod. Any additional sheet or sheets may be crimped prior to being gathered. Any additional sheet or sheets may comprise additional aerosol-forming materials, such as one or more additional sheets of homogenised tobacco. Any additional sheet or sheets may comprise flavour components for modifying the flavour of the aerosol.

A rod may comprise one or more additional sheets of material gathered together with the first and second sheets to form the rod. Any additional sheet or sheets may be textured, for example crimped, prior to being gathered. Any additional sheet or sheets may comprise additional aerosol-forming materials, such as one or more additional sheets of homogenised tobacco.

A rod as described herein may be used as an aerosol-forming substrate in an aerosol-generating article.

An aerosol generating article may be provided comprising a rod as described herein.

A number of aerosol-generating articles in which an aerosol-forming substrate is heated rather than combusted have been proposed in the art. Typically in heated aerosol-generating articles, an aerosol is generated by the transfer of heat from a heat source, for example a chemical, electrical or combustible heat source, to a physically separate aerosol-forming substrate, which may be located within, around or downstream of the heat source.

As used herein, the term 'aerosol-forming substrate' denotes a substrate consisting of or comprising an aerosol-forming material that is capable of releasing volatile compounds upon heating to generate an aerosol. A sheet of tobacco material is an aerosol-forming substrate for the purposes of this specification.

Rods as described herein are particularly suited for use as aerosol-forming substrates of heated aerosol-generating articles. Aerosol-forming substrates in heated aerosol-generating articles are typically significantly shorter in rod length than rods of combustible smokable material in conventional lit-end smoking articles. As noted above, loose ends, high weight standard deviations and non-uniform densities as exhibited by rods comprising shreds of tobacco material are particularly undesirable in rods of aerosol-generating material having a short rod length. Use of short rods as described herein as aerosol-generating substrates in heated aerosol-generating articles advantageously minimises or avoids one or more of the disadvantages associated with the use of short rods comprising shreds of tobacco material previously discussed above.

In one embodiment, rods as described herein may be used as aerosol-forming substrates in heated aerosol-generating articles comprising a combustible heat source and an aerosol-generating substrate downstream of the combustible heat source.

For example, rods as described herein may be used as aerosol-generating substrates in heated aerosol-generating articles of the type disclosed in WO-A-2009/022232, which comprise a combustible carbon-based heat source, an aerosol-generating substrate downstream of the combustible heat source, and a heat-conducting element around and in contact with a rear portion of the combustible carbon-based heat source and an adjacent front portion of the aerosol-generating substrate. However, it will be appreciated that rods as described herein may also be used as aerosol-generating substrates in heated aerosol-generating articles comprising combustible heat sources having other constructions.

In another embodiment, rods as described herein may be used as aerosol-generating substrates in heated aerosol-generating articles for use in electrically-operated aerosol-generating systems in which the aerosol-generating substrate of the heated aerosol-generating article is heated by an electrical heat source.

For example, rods as described herein may be used as aerosol-generating substrates in heated aerosol-generating articles of the type disclosed in EP-A-0 822 670.

A system may be provided comprising an electrically-operated aerosol-generating apparatus and an aerosol-generating article for use with the apparatus. The aerosol-generating article comprises a rod or an aerosol-forming substrate as described herein.

A filter for an aerosol-generating article may be provided, wherein the filter comprises a rod as described herein. Rods may be used in filters for both lit-end aerosol-generating articles, such as conventional smoking articles, and heated aerosol-generating articles. Rods as described herein may used in filters comprising a single filter segment. Rods as described herein may also be used in multi-component filters comprising two or more filter segments.

Filters comprising tobacco-containing filter segments are known in the art. For example, EP-A-1 889 550 discloses a multi-component filter for a smoking article comprising: a mouth end segment; a first flavour release segment comprising tobacco or other plant leaf upstream of the mouth end segment; and a second flavour release segment comprising filtration material and a flavourant upstream of the first flavour release segment. The resistance to draw of the second flavour release segment is greater than the resistance to draw of the first flavour release segment and the resistance to draw of the second flavour release segment is greater than the resistance to draw of mouth end segment.

In certain embodiments, rods as described herein may be used as tobacco-containing filter segments in single or multi-component filters.

Filters comprising rods as described herein may further comprise one or more filtration materials for the removal of particulate components, gaseous components or a combination thereof. Suitable filtration materials are known in the art and include, but are not limited to: fibrous filtration materials such as, for example, cellulose acetate tow and paper; adsorbents such as, for example, activated alumina, zeolites, molecular sieves and silica gel; biodegradable polymers including, for example, polylatic acid (PLA), Mater-Bi®, and bioplastics; and combinations thereof.

Alternatively or in addition, filters comprising rods as described herein may further comprise one or more smoke or aerosol-modifying agents. Suitable smoke and aerosol-modifying agents are known in the art and include, but are not limited to: flavourants such as, for example, menthol.

Preferably, rods according to the specification are of substantially uniform cross-section.

Rods according to the specification may be produced having different dimensions depending upon their intended use.

For example, rods according to the specification may have a diameter of between about 5 mm and about 10 mm depending upon their intended use.

For example, rods according to the specification may have a rod length of between about 5 mm and about 150 mm depending upon their intended use.

In preferred embodiments, rods according to the specification for use as aerosol-forming substrates in heated aerosol-generating articles may have a rod length of between about 5 mm and about 20 mm or about 30 mm.

In further embodiments, rods according to the specification for use in filters for conventional lit-end smoking articles and heated aerosol-generating articles may have a rod length of between about 5 mm and about 30 mm.

Rods according to the specification of a desired unit rod length may be produced by forming a rod of multiple unit rod length and then cutting or otherwise dividing the rod of multiple unit rod length into multiple rods of the desired unit rod length.

For example, rods having a rod length of about 15 mm for use as aerosol-forming substrates in heated aerosol-generating articles may be produced by forming a rod having a rod length of about 150 mm and then severing the elongate rod into ten rods having a rod length of about 15 mm.

Preferred embodiments comprise sheets of homogenised tobacco material. Sheets of homogenised tobacco material may be formed by agglomerating particulate tobacco obtained by grinding or otherwise comminuting one or both of tobacco leaf lamina and tobacco leaf stems. Alternatively, or in addition, sheets of homogenised tobacco material tobacco may comprise one or more of tobacco dust, tobacco fines and other particulate tobacco by-products formed during, for example, the treating, handling and shipping of tobacco. Where rods according to the specification are intended for use as aerosol-forming substrates in heated aerosol-generating articles, sheets of homogenised tobacco material used to form the rods preferably comprise particulate tobacco obtained by grinding or otherwise comminuting tobacco leaf lamina.

In certain embodiments, sheets of homogenised tobacco material may have a tobacco content of at least about 40% by weight on a dry weight basis or of at least about 50% by weight on a dry weight basis. In other embodiments, sheets of homogenised tobacco material may have a tobacco content of about 70% or more by weight on a dry weight basis. Where rods according to the specification are intended for use as aerosol-forming substrates in heated aerosol-generating articles, the use of sheets of homogenised tobacco material having high tobacco contents advantageously generates aerosols with enhanced tobacco flavour.

Sheets of homogenised tobacco material may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof.

Suitable extrinsic binders for inclusion in sheets of homogenised tobacco material for use in forming a rod as described herein are known in the art and include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof.

Suitable non-tobacco fibres for inclusion in sheets of homogenised tobacco material are known in the art and include, but are not limited to: cellulose fibers; soft-wood fibres; hard-wood fibres; jute fibres and combinations thereof. Prior to inclusion in sheets of homogenised tobacco material, non-tobacco fibres may be treated by suitable processes known in the art including, but not limited to: mechanical pulping; refining; chemical pulping; bleaching; sulfate pulping; and combinations thereof.

Sheets of homogenised tobacco material for use in forming rods as described herein should have sufficiently high tensile strength to survive being gathered to form rods. In certain embodiments non-tobacco fibres may be included in sheets of homogenised tobacco material in order to achieve an appropriate tensile strength.

For example, homogenised sheets of tobacco material for forming rods as described herein may comprise between about 1% and about 5% non-tobacco fibres by weight on a dry weight basis.

Suitable aerosol-formers and humectants for inclusion in sheets of homogenised tobacco material are known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

For example, where rods according to the specification are intended for use as aerosol-forming substrates in heated aerosol-generating articles, sheets of homogenised tobacco material for use in forming rods as described herein may have an aerosol former content of between about 5% and about 30% by weight on a dry weight basis. Rods intended for use in electrically-operated aerosol-generating system having a heating element may preferably include an aerosol former of greater than 5% to about 30%. For rods intended for use in electrically-operated aerosol-generating system having a heating element, the aerosol former may preferably be glycerine.

It will be appreciated that the composition of sheets of homogenised tobacco material may be designed to comply with regulatory requirements.

A number of reconstitution processes for producing sheets of homogenised tobacco materials are known in the art. These include, but are not limited to: paper-making processes of the type described in, for example, U.S. Pat. No. 3,860,012; casting or 'cast leaf' processes of the type described in, for example, U.S. Pat. No. 5,724,998; dough reconstitution processes of the type described in, for example, U.S. Pat. No. 3,894,544; and extrusion processes of the type described in, for example, in GB-A-983,928. Typically, the densities of sheets of homogenised tobacco material produced by extrusion processes and dough reconstitution processes are greater than the densities of sheets of homogenised tobacco materials produced by casting processes.

Sheets of homogenised tobacco material for use in forming rods as described herein are preferably formed by a casting process of the type generally comprising casting a slurry comprising particulate tobacco and one or more binders onto a conveyor belt or other support surface, drying the cast slurry to form a sheet of homogenised tobacco material and removing the sheet of homogenised tobacco material from the support surface.

For example, in certain embodiments sheets of homogenised tobacco material may be formed from slurry comprising particulate tobacco, guar gum, cellulose fibres and glycerine by a casting process.

Sheets of homogenised tobacco material may be textured using suitable known machinery for texturing filter tow, paper and other materials.

For example, sheets of homogenised tobacco material for forming rods as described herein may be crimped using a crimping unit of the type described in CH-A-691156, which comprises a pair of rotatable crimping rollers. However, it will be appreciated that sheets of homogenised tobacco material may be textured using other suitable machinery and processes that deform or perforate the sheets of homogenised tobacco material.

Rods as described herein may be produced from sheets of homogenised tobacco material and sheets of non-tobacco material having different dimensions depending upon their intended use. Sheets of homogeneous tobacco material and non-tobacco material should be of sufficient width to be gathered to form a rod as described herein.

Preferably, sheets of material for use in forming rods as described herein have a width of at least about 25 mm.

In certain embodiments sheets of material for use in rods as described herein may have a width of between about 25 mm and about 300 mm.

Preferably, the sheets of material that make up the rod have a combined thickness of at least about 50 μm to about 300 μm.

In certain embodiments, individual sheets of material for use in forming rods as described herein may have a thickness of between 10 μm and about 300 μm. Non-tobacco sheets such as sheets of polymer or sheets of aluminium foil may have a lower thickness than sheets of aerosol-forming material.

In certain embodiments, sheets of homogenised tobacco material for use in forming rods as described herein may have a grammage 100 $g/m^2$ and about 300 $g/m^2$.

Rods as described herein may comprise a gathered sheet of homogenised tobacco material circumscribed by a porous wrapper or a non-porous wrapper.

In certain embodiments, rods as described herein may comprise a sheet of homogenised tobacco material and a sheet of paper or polymer material gathered together and circumscribed by a paper wrapper.

Suitable paper wrappers are known in the art and include, but are not limited to: cigarette papers; and filter plug wraps.

In other embodiments, rods as described herein may comprise a non-paper wrapper.

Suitable non-paper wrappers are known in the art and include, but are not limited to: homogenised tobacco materials.

Rods as described herein may be produced using conventional cigarette making and cigarette filter making machinery, adapted to allow for the gathering of two or more sheets simultaneously.

For example, rods comprising a crimped sheet of homogeneous tobacco material and a sheet of non-tobacco material may be produced using an adaptation of machinery for forming filter rods comprising a gathered crimped sheet of paper of the type described in CH-A-691156. The machinery could be adapted to allow a sheet of non-tobacco material to be gathered together with a crimped tobacco sheet.

As described herein there is also provided a method of forming a rod as described herein comprising the steps of: providing a first continuous sheet comprising an aerosol-forming material, providing a second continuous sheet comprising a non-tobacco material, the second sheet being different from the first sheet, simultaneously gathering the first and second continuous sheets transversely relative to the longitudinal axes thereof; circumscribing the gathered sheets with a wrapper to form a continuous rod, and severing the continuous rod into a plurality of discrete rods. The aerosol-forming material may be any aerosol-forming material described above, and is preferably homogenised tobacco. The non-tobacco material may be any non-tobacco material described above, and preferably comprises a polymeric sheet, a paper sheet, or a metallic foil sheet.

The method may further comprise texturing the first continuous sheet. For example, the method may comprise crimping, embossing, perforating or otherwise texturing the first continuous sheet prior to gathering the first continuous sheet together with the second continuous sheet.

Preferably, the method further comprises crimping the first continuous sheet.

Both first and second continuous sheets may be textured, for example crimped.

Specific embodiments will be further described, by way of example only, with reference to the accompanying drawings in which.

Figure 1:
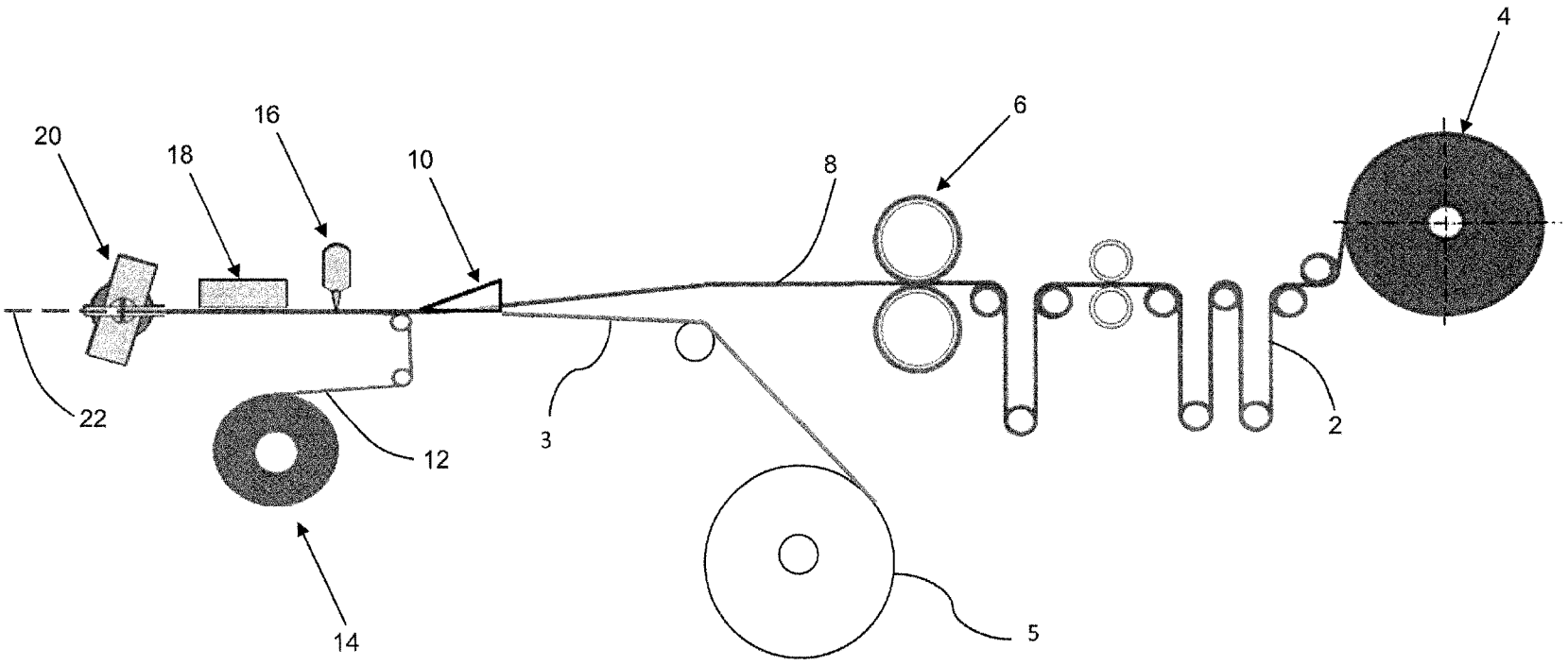
FIG. 1 shows a schematic cross-section of apparatus for forming a rod according to a specific embodiment.

The apparatus shown in FIG. 1 generally comprises: supply means for providing a continuous sheet of homogenised tobacco material; supply means for providing a continuous sheet of PLA material; crimping means for crimping the continuous sheet of homogenised tobacco material; rod forming means for gathering the continuous crimped sheet of homogenised tobacco material together with the continuous sheet of PLA material and circumscribing the gathered material with a wrapper to form a continuous rod; and cutting means for severing the continuous rod into a plurality of discrete rods. The apparatus also comprises transport means for transporting the continuous sheet of homogenised tobacco material downstream through the apparatus from the supply means to the rod forming means via the crimping means.

As shown in FIG. 1, the supply means for providing a continuous sheet of homogenised tobacco material comprises a continuous sheet of homogenised tobacco material 2 mounted on a first bobbin 4. The supply means for providing a continuous sheet of PLA comprises a continuous sheet of PLA 3 mounted on a second bobbin 5. The crimping means comprises a pair of rotatable crimping rollers 6. In use, the continuous sheet of homogenised tobacco material 2 is drawn from the first bobbin 4 and transported downstream to the pair of crimping rollers 6 by the transport mechanism via a series of guide and tensioning rollers. As the continuous sheet of homogenised tobacco material 2 is fed between the pair of crimping rollers 6, the crimping rollers engage and crimp the continuous sheet of homogenised tobacco material 2 to form a continuous crimped sheet of homogenised tobacco material 8 having a plurality of spaced-apart ridges or corrugations substantially parallel to the longitudinal axis of the sheet of homogenised tobacco material through the apparatus.

The continuous crimped sheet of homogenised tobacco material 8 is transported downstream from the pair of crimping rollers 6 towards the rod forming means. The continuous sheet of PLA 3 is transported from the second bobbin 5 towards the rod forming means. Both the continuous sheet of PLA 3 and the continuous sheet of crimped homogenised tobacco material 8 are simultaneously fed through a converging funnel or horn 10. The converging funnel 10 gathers the continuous sheets of material 8, 3 transversely relative to their longitudinal axes. The continuous sheets of material 8,3 assume a substantially cylindrical configuration as they pass through the converging funnel 10.

Upon exiting the converging funnel 10, the gathered sheets of homogenised tobacco material and PLA are wrapped in a continuous sheet of wrapping material 12. The continuous sheet of wrapping material is fed from a bobbin 14 and enveloped around the gathered continuous crimped sheet of homogenised tobacco material by an endless belt conveyor or garniture. As shown in FIG. 1, the rod forming means comprises an adhesive application means 16 that applies adhesive to one of the longitudinal edges of the continuous sheet of wrapping material, so that when the opposed longitudinal edges of the continuous sheet of wrapping material are brought into contact they adhere to one other to form a continuous rod.

The rod forming means further comprises a drying means 18 downstream of the adhesive application means 16, which in use dries the adhesive applied to the seam of the continuous rod as the continuous rod is transported downstream from the rod forming means to the cutting means.

The cutting means comprises a rotary cutter 20 that severs the continuous rod into a plurality of discrete rods of unit length or multiple unit length.

As the two continuous sheets of material are fed into the converging funnel while overlaid, one sheet on top of the other, the rod has an even distribution of tobacco sheet and PLA sheet.

Figure 2:
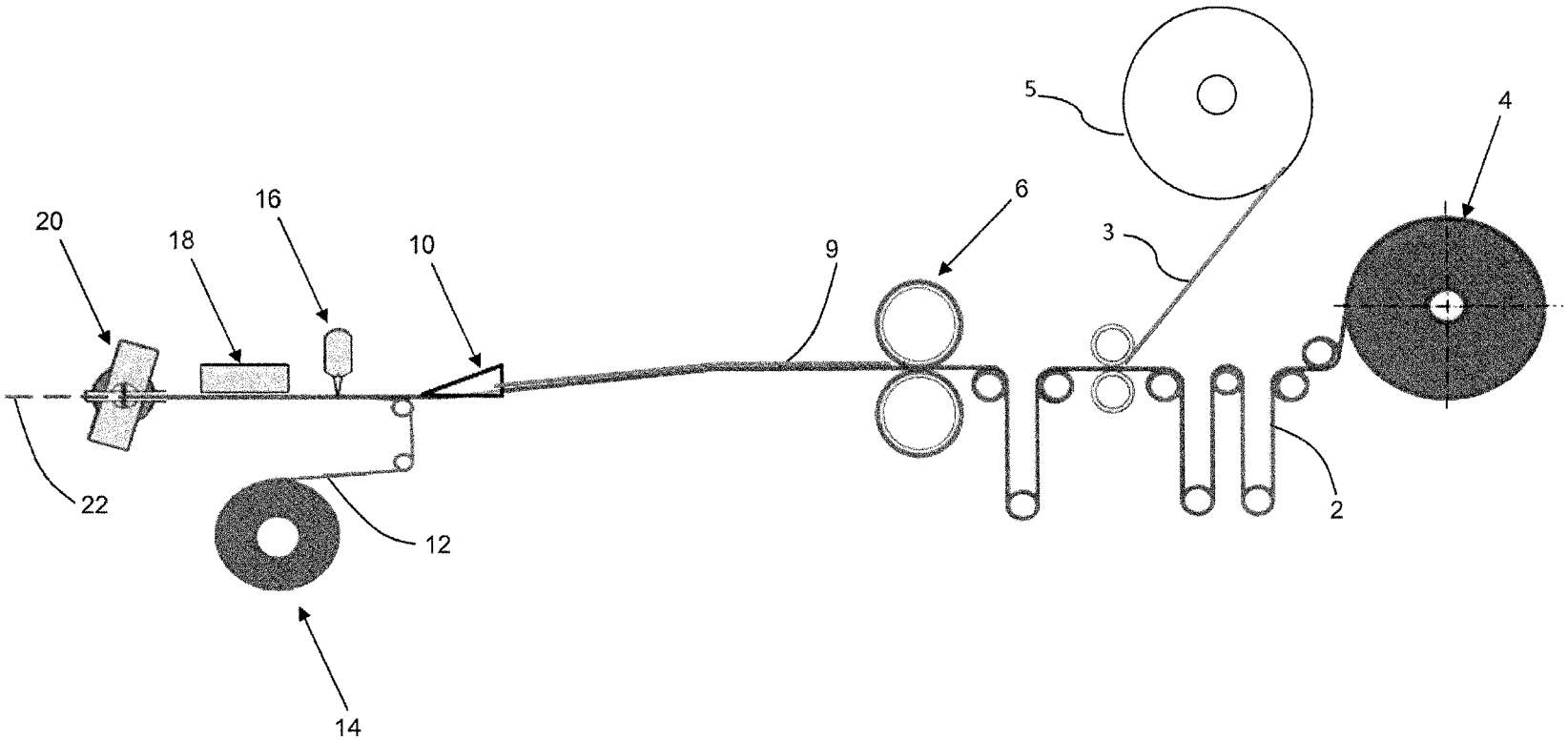
FIG. 2 shows a schematic cross-section of apparatus for forming a rod according to a specific embodiment.

In an alternative configuration illustrated in FIG. 2, a continuous sheet of PLA 3 is positioned in overlapping relationship with a continuous sheet of homogenised tobacco material 2 upstream of a pair of crimping rollers 6. The apparatus is otherwise substantially as described above in relation to FIG. 1.

Both continuous sheets of material 2,3 pass through the crimping rollers 6 in overlapping relationship and are simultaneously crimped. A crimped pair of continuous sheets 9 passes out of the crimping rollers 6 and downstream into the converging funnel 10 to be formed into a rod.

Figure 3:
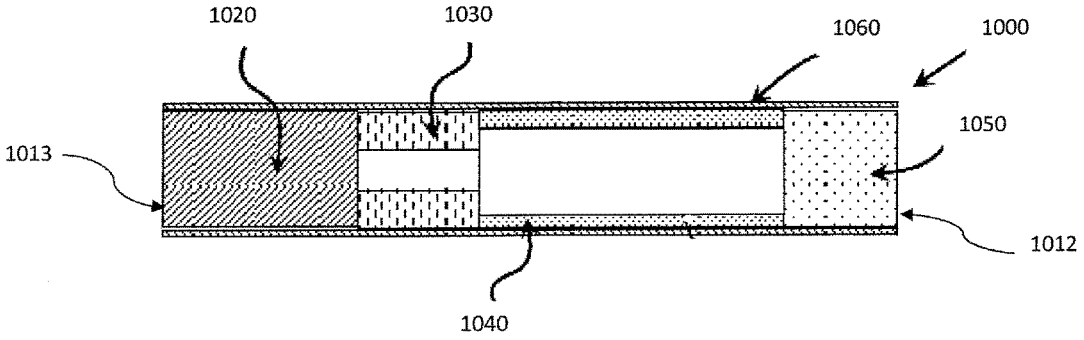
FIG. 3 illustrates an embodiment of an aerosol-generating device that incorporate rods formed as described herein.

FIG. 3 illustrates an embodiment of an aerosol-generating article 1000 comprising a rod as described herein. The article 1000 comprises four elements; an aerosol-forming substrate 1020, a hollow cellulose acetate tube 1030, a spacer element 1040, and a mouthpiece filter 1050. These four elements are arranged sequentially and in coaxial alignment and are assembled by a cigarette paper 1060 to form the aerosol-generating article 1000. The article 1000 has a mouth-end 1012, which a user inserts into his or her mouth during use, and a distal end 1013 located at the opposite end of the article to the mouth end 1012. The embodiment of an aerosol-generating article illustrated in FIG. 3 is particularly suitable for use with an electrically-operated aerosol-generating device comprising a heater for heating the aerosol-forming substrate.

When assembled, the article 1000 is about 45 millimeters in length and has an outer diameter of about 7.2 millimeters and an inner diameter of about 6.9 millimeters.

The aerosol-forming substrate 1020 comprises a rod formed from a first sheet of crimped cast-leaf tobacco and a second sheet of crimped PLA, wrapped in a filter paper (not shown) to form a plug.

An aerosol-generating article 1000 as illustrated in FIG. 3 is designed to engage with an aerosol-generating device in order to be consumed. Such an aerosol-generating device includes means for heating the aerosol-forming substrate 1020 to a sufficient temperature to form an aerosol. Typically, the aerosol-generating device may comprise a heating element that surrounds the aerosol-generating article 1000 adjacent to the aerosol-forming substrate 1020, or a heating element that is inserted into the aerosol-forming substrate 1020.

Once engaged with an aerosol-generating device, a user draws on the mouth-end 1012 of the smoking article 1000 and the aerosol-forming substrate 1020 is heated to a temperature of about 375 degrees Celsius. At this temperature, volatile compounds are evolved from the sheet of cast-leaf tobacco of the aerosol-forming substrate 1020. These compounds condense to form an aerosol. The aerosol is drawn through the filter 1050 and into the user's mouth.

Figure 4:
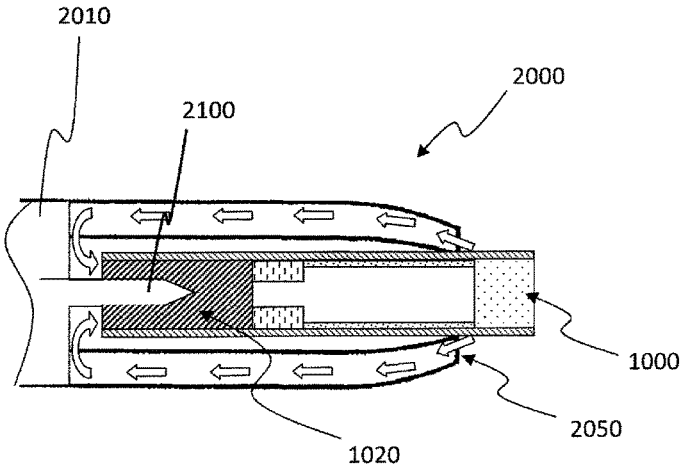
FIG. 4 illustrates an aerosol-generating system comprising an electrically-operated aerosol-generating device and an aerosol-generating article as illustrated in FIG. 3.

FIG. 4 illustrates a portion of an electrically-operated aerosol-generating system 2000 that utilises a heating blade 2100 to heat an aerosol-generating substrate 1020 of an aerosol-generating article 1000. The heating blade is mounted within an aerosol article receiving chamber of an electrically-operated aerosol-generating device 2010. The aerosol-generating device defines a plurality of air holes 2050 for allowing air to flow to the aerosol-generating article 1000. Air flow is indicated by arrows on FIG. 4. The aerosol-generating device comprises a power supply and electronics, which are not illustrated in FIG. 4. The aerosol-generating article 1000 of FIG. 4 is as described in relation to FIG. 3.

EXAMPLE 1

Rods according to a first specific embodiment comprise a crimped sheet of homogenised tobacco material gathered together with an un-crimped sheet of PLA, circumscribed by a paper wrapper and having a length of 12 mm and diameters of between 6.9 mm and 7.2 mm were produced at rates of between 20 m/min and 25 m/min using apparatus of the type shown in FIG. 1.

The continuous sheets of homogenised tobacco material were produced by a casting process, the sheets having a width of between 110 mm and 134 mm, a thickness of 120 μm to 260 μm, a grammage of between 167 g/m$^2$ and 201 g/m$^2$ and a moisture content of between 5% and 12%.

The invention claimed is:

1. A system, comprising an electrically-operated aerosol-generating apparatus and an aerosol-generating article for use with the apparatus, the aerosol-generating article comprising an aerosol-forming substrate comprising, a rod comprising a first sheet comprising aerosol-forming material, and a second sheet of non-tobacco material, wherein the first sheet is a sheet of homogenized tobacco material; the first sheet and the second sheet are constricted substantially around a longitudinal axis of the rod by a converging funnel such that the first sheet and the second sheet assume a substantially cylindrical configuration; and the first sheet and the second sheet are circumscribed by a wrapper.

2. The system according to claim 1, wherein the second sheet comprises a functional component for modifying an aerosol evolved from the first sheet of aerosol-forming material.

3. The system according to claim 1, wherein the second sheet is a polymeric or paper sheet.

4. The system according to claim 1, wherein the second sheet comprises an adsorbent material for adsorbing phenolic compounds.

5. The system according to claim 1, wherein the second sheet comprises a biodegradable polymer.

6. The system according to claim 1, wherein the second sheet comprises carbon.

7. The system according to claim 1, wherein the second sheet comprises a humectant.

8. The system according to claim 1, wherein at least one of the first sheet and the second sheet is crimped.

9. The system according to claim 1, comprising at least one sheet of tobacco material and at least two sheets of non-tobacco material.

10. The system according to claim 1, wherein the second sheet comprises polylactic acid.

* * * * *